US009840670B2

(12) United States Patent
Carter

(10) Patent No.: US 9,840,670 B2
(45) Date of Patent: Dec. 12, 2017

(54) CHEMICAL CONVERSION OF CARBON DIOXIDE AND WATER TO HYDROCARBON FUELS

(71) Applicant: M. K. Carter, Lincoln, CA (US)

(72) Inventor: M. K. Carter, Lincoln, CA (US)

( * ) Notice: Subject to any disclaimer, the term of this patent is extended or adjusted under 35 U.S.C. 154(b) by 63 days.

(21) Appl. No.: 15/153,612

(22) Filed: May 12, 2016

(65) Prior Publication Data

US 2017/0327748 A1 Nov. 16, 2017

(51) Int. Cl.
*C10G 2/00* (2006.01)

(52) U.S. Cl.
CPC ..... *C10G 2/00* (2013.01)

(58) Field of Classification Search
None
See application file for complete search history.

(56) References Cited

U.S. PATENT DOCUMENTS 4,327,239 A * 4/1982 Dorrance ..... B01J 19/127 585/638
5,710,087 A * 1/1998 Swanson ..... B01J 27/232 208/400
7,459,590 B2 * 12/2008 Olah ..... C07C 1/20 568/884
8,604,263 B2 * 12/2013 Barenbaum ..... C01B 3/06 423/579
8,946,462 B2 * 2/2015 Schaub ..... C07C 51/15 556/18
9,085,497 B2 * 7/2015 Jennings ..... C10G 2/50
9,174,890 B2 * 11/2015 Ba-Abbad ..... C07C 1/0495
2008/0223727 A1 * 9/2008 Oloman ..... B01D 53/326 205/413
2010/0258446 A1 * 10/2010 Mohapatra ..... C25B 1/003 205/340

* cited by examiner

*Primary Examiner* — Philip Louie

(57) ABSTRACT

Carbon dioxide is hydrogenated by water at elevated temperature in an inorganic sulfate fortified sulfuric acid medium, in the presence of a transition metal catalyst and the absence of a sacrificial metal or hydrogen gas. The reaction sequence forms formaldehyde, immediately forming glycolaldehyde then concatenating to longer hydrocarbon chains possessing at least one alcohol group to maintain solubility in the reaction medium. As products of sufficient molecular weight are attained the alcohol group becomes hydrogenated and the hydrocarbons vaporize. Water's hydrogen is sacrificed as the byproduct oxygen reacts with sulfuric acid forming monoperoxysulfuric acid (Caro's acid) that decomposes at elevated temperatures. Products are removed under partial vacuum to preclude partial oxidation of the hydrocarbon fuels facilitating a continuous process.

1 Claim, No Drawings

CHEMICAL CONVERSION OF CARBON DIOXIDE AND WATER TO HYDROCARBON FUELS

REFERENCES CITED

U.S. Patent Documents

| Pat. No. | Issue Date | Author | Comments |
|---|---|---|---|
| 9,174,890 | Nov. 3, 2015 | M. A. Ba-Abbad, et al | $CO_2 + Mg + H_2O \rightarrow CO + H_2$<br>$CO + H_2 + Ca \rightarrow CaC_2 + H_2O$ . . . |
| 9,085,497 | Jul. 21, 2015 | J. R. Jennings | $CO_2 + H_2 \rightarrow CO + H_2 \rightarrow C_nH_{2n+2}$<br>(F-T) |
| 8,946,462 | Feb. 3, 2015 | T. Schaub, et al | $CO_2 + H_2 \rightarrow HCO_2H$<br>tr met cat + phosphine ligand + . . . |
| 8,604,263 | Dec. 10, 2013 | A. A. Barenbaum | $CO_2 + cat + H_2O \rightarrow HC + H_2$<br>cat is a metal or alloy |
| 7,459,590 | Dec. 2, 2008 | G. Olah | $H_2O + H_2 + CO_2 \rightarrow CH_3OH$ . . . |
| 5,710,087 | Jan. 20, 1998 | R. C. Swanson | $H_2O + CO_2 \rightarrow CO + H_2 \rightarrow HC$<br>($MgCO_3/OH$) at 370° C. to 908° C. (on coal) |
| 4,327,239 | Apr. 27, 1982 | W. H. Dorrance | $H_2O + CO_2 \rightarrow HC + O_2$<br>(zeolite for sacrificial metal) at 500° C. |

BACKGROUND

Field of Invention

The proposed method for production of hydrocarbon fuels uses carbon dioxide and water available as decomposition products of combustion, widely occurring in the atmosphere. This invention relates to production of cost-effective hydrocarbons from waste products and may be competitive with those refined from petroleum.

Description of Prior Art

Hydrocarbon fuels, including gasoline and diesel fuel, are used to power internal combustion engines in commerce, in the electric power industry and other industrial sectors. There are a wide variety of industrial methods for synthesis and production of these products, however nearly all rely on non-renewable petroleum resources. While alternate resources, such as production of ethanol from natural, renewable cellulosics and starchy foods, are becoming sustainable their costs are usually greater than the cost of crude oil. Production of hydrocarbon fuels from carbon dioxide, a waste gas that is free for the taking, could substantially reduce the cost.

Modern methods for industrial production of hydrocarbon fuels are based on the following processes:

1) Petroleum or crude oil is pumped from wells, delivered to refineries and processed into gasoline, jet fuels, diesel fuel, heating oil and other products. This is a well-known process but petroleum is becoming a limited resource that may have a residual life of 75 years.

2) Natural gas and related oil products are released from wells and porous shale rock formations by fracturing the strata using pressurized fluids (fracking). An example is disclosed in U.S. Pat. No. 8,875,790, issued to Henry A. Baski, Nov. 4, 2014. Production of this fuel resource is practical above a well head price near $50 per barrel. This resource may have a residual life of 25 to 30 years.

3) Deep ocean methane gas hydrate fields are presently being prospected, explored and developed as taught in U.S. Pat. No. 8,783,364, issued to Yojiro Ikegawa, Jul. 22, 2014 but may be of limited value in world commerce.

4) Artificial hydrocarbon production using the Fischer-Tropsch process converting synthesis gas (carbon monoxide and hydrogen) to condensed hydrocarbons (waxes) followed by catalytic cracking to liquid fuels is expensive but viable. This industrially viable process, as represented by U.S. Pat. No. 8,975,304, issued to Jacobus Lucas Visagie, Mar. 10, 2015, has been conducted in South Africa by Sasol for over fifty years. This process is also expensive but continues to be of commercial value in a captured market.

5) Hydrocarbon fuels have been produced on a limited scale by extraction from oil bearing plants. For example, soybean oil has been used in production of biodiesel, as disclosed in U.S. Pat. No. 9,000,244, issued to Oleg Kozyuk, Apr. 7, 2015. Some of these products can be used directly as diesel fuel but the cost of this fuel is relatively high.

The present application discloses use of essentially free carbon dioxide as a source of carbon hydrogenated by hydrogen atoms from water for production of fuel hydrocarbons using a fortified sulfuric acid medium. This catalytic conversion process is most efficient at elevated temperatures as described herein.

Methods for industrial production of hydrocarbon fuels from carbon dioxide and water, without use of hydrogen gas, coal or a sacrificial metal such as magnesium or iron, were not identified in the literature.

SUMMARY OF THE INVENTION

This invention describes a chemical process using selected members of transition metal catalysts for catalytic conversion of carbon dioxide to hydrocarbons. This process is rapid and direct in that carbon dioxide mixed into an inorganic sulfate saturated sulfuric acid medium at an elevated temperature using available hydrogen atoms from water forms hydrocarbon fuels.

It is an object of this invention, therefore, to provide a catalytic process facilitating conversion of carbon dioxide to hydrocarbons in a sulfate fortified acid reaction medium. It is another object of this invention to catalytically convert carbon dioxide and water to hydrocarbon fuels. It is still another object of this invention to catalytically convert carbon dioxide and water to hydrocarbons at elevated temperature. Other objects of this invention will be apparent from the detailed description thereof which follows, and from the claims.

DETAILED DESCRIPTION OF THE INVENTION

Carbon dioxide gas is a main product of combustion, in addition to heat and water. All fires, boiler heating and vehicle exhaust generate tons of carbon dioxide every day and have been for centuries. As a result carbon dioxide concentration in Earth's atmosphere has risen from 270 ppm to over 400 ppm in recent years. In addition, carbon dioxide is a byproduct of the fermentation of sugar in the production of alcoholic beverages and bioethanol. Carbon dioxide comprises about 40-45% of the gas that emanates from decomposition to biogas in landfills. This increasing atmospheric concentration of carbon dioxide has been shown to contribute to global warming. Near term stability of the atmospheric environment of planet Earth requires a reduction in the rate of generation of this atmospheric pollutant including methods to reduce its concentration by converting carbon dioxide gas to useful products.

Carbon dioxide gas is catalytically converted to hydrocarbons in hot sulfuric acid wherein hydrogen atoms are supplied by water. Cobalt and manganese sulfate are the preferred catalysts and 70% to 100%, nominally 90% sulfuric acid, saturated with sodium sulfate, potassium sulfate and zinc sulfate, heated to 180° C. to 300° C., nominally 250° C., is the preferred reaction medium. Carbon dioxide gas is dispersed in the hot acid reaction medium as tiny bubbles. Preliminary, individual chemical reaction steps are presented herein.

Ambient temperature chemical conversion of glucose to ethanol in dilute sulfuric acid saturated with sulfate salts produced glycolaldehyde as a byproduct (M.K. Carter, Industrial Chemicals from Natural Products I. Reaction Mechanism for Glucose to Ethanol and Glycolaldehyde) rather than carbon dioxide gas. Glycolaldehyde was isolated, had a measured melting point of 98° C. to 101° C. and an FTIR spectrum was recorded confirming its formation. Since ethanol forms a complex with sulfuric acid then alcohols and glycols cannot be distilled (without chemical displacement) and remain in the liquid reaction medium until higher boiling hydrocarbons have been formed and released in the vapor phase.

The catalytic chemical process proceeds as carbon dioxide is hydrogenated to form formaldehyde that immediately couples with other formaldehyde to produce glycolaldehyde.

Chain growth or carbon backbone concatenation continues by aldol condensation. Once carbon chain length becomes sufficient the alcohol groups are hydrogenated and hydrocarbon compounds vaporize leaving the liquid reaction medium.

Continuous addition of carbon dioxide to the reaction medium causes formation of an abundance of partially hydrogenated carbon compounds that concatenate in formation of higher molecular weight alcohol compounds. The final reaction step is replacement of the —OH groups by —H groups resulting in formation of hydrocarbon compounds. Hydrocarbons form in a nominal carbon range of $C_8$ to $C_{24}$ producing gasoline and diesel fuel.

Process equipment consisted of a 6 gallon stainless steel alloy 316 reactor with inlet and outlet ports and two glass sight ports. Mixing was provided by a pump that continuously recycled outlet fluid to a bottom inlet port. Compressed carbon dioxide gas was slowly bled into the reactor by means of a metering valve and was diffused in the reaction medium by means of a gas diffuser producing micro-fine bubbles. An outlet port connected to a cooled liquid trap followed by a mechanical vacuum pump was employed for removal of the hydrocarbon products. Any residual product acidity may be neutralized before processing the fuels.

A metered amount of steam was injected into the reactor periodically to maintain 90% sulfuric acid since water was consumed as part of the reaction chemistry. This was accomplished using small bubbles of steam so as not to cause thermal spikes in the reactor.

The condensed products contained over 90% hydrocarbons in the compound range between octane ($C_8$) and tetracosane ($C_{24}$). These included gasoline and diesel fuel plus minor amounts of other compounds. In addition the products contained approximately 5% alcohols in a similar molecular weight range. These products can be separated into gasoline and diesel fuel in a distillation tower.

Consider this process to be run in 90% sulfuric acid at 250° C. in formation of liquid hydrocarbon fuels. Economic success of this process is based on availability of inexpensive carbon dioxide, inexpensive water and low process facility costs. This process could provide large quantities of gasoline and diesel fuel at low cost while recharging the atmosphere with the byproduct oxygen. Thus, no petroleum, other organic compounds or coal is required in production of hydrocarbon fuels using this process.

EXAMPLES OF CHEMICAL CONVERSION PROCESSES

Process Example 1

The open and completely plumbed 6 gallon 316 alloy stainless steel reactor was charged with 5 gallons of 90% sulfuric acid saturated with 0.24% potassium sulfate, 2.4% sodium sulfate and 0.96% zinc sulfate heptahydrate (reaction medium density=1.88 g/mL, 15.72 pounds/gallon) plus 3.5 grams (0.0078 pound) cobalt sulfate hexahydrate. The reactor was bolted closed, heated using an electric heating jacket and the mixing pump turned on. Once the 250° C. operating temperature was attained compressed carbon dioxide gas was metered into the internal gas diffuser at a rate of 0.25 L/minute to begin the reaction. Low pressure steam was injected periodically to maintain sulfuric acid at 90%. The reaction was run for 1 hour as product vapor was removed by means of the vacuum pump and the condensed liquid recovered from the cold trap receiver. Some 24 grams of product liquid was recovered with density between 0.82 g/mL and 0.84 g/mL. The product boiling range was 40° C. to 280° C. for octane to tricosane.

Process Example 2

The reactor was charged with 5 gallons of 90% sulfuric acid saturated with 0.24% potassium sulfate, 2.4% sodium sulfate and 0.96% zinc sulfate heptahydrate (reaction medium density=1.88 g/mL, 15.72 pounds/gallon) plus 3.0 grams (0.0067 pound) cobalt sulfate hexahydrate. The reactor was closed, heated using an electric heating jacket and the mixing pump turned on. Once the 225° C. operating temperature was attained compressed carbon dioxide gas was metered into the internal gas diffuser at a rate of 0.25 L/minute to begin the reaction. Low pressure steam was injected periodically to maintain sulfuric acid at 90%. The reaction was run for 1 hour as product vapor was removed by means of the vacuum pump and the condensed liquid recovered from the cold trap receiver. Some 12 grams of product liquid was recovered with density between 0.81 g/mL and 0.82 g/mL. The boiling range was 40° C. to 265° C. for octane to heptadecane.

What is claimed:

1. A chemical process comprising reacting carbon dioxide with a sulfuric acid medium comprising water, inorganic sulfates and 70% to less than 100% sulfuric acid in the presence of a transition metal sulfate catalyst selected from the group consisting of cobalt or manganese sulfate, at 180° C. to 300° C. to produce hydrocarbons, wherein the inorganic sulfates are selected from the group consisting of sodium sulfate, potassium sulfate, zinc sulfate and combinations thereof, and the process takes place in the absence of added hydrogen gas or a sacrificial metal.

* * * * *